US006779655B2

(12) United States Patent
Olsen et al.

(10) Patent No.: US 6,779,655 B2
(45) Date of Patent: Aug. 24, 2004

(54) LABEL PANEL CONTAINER CARRIER WITH INTEGRAL HANDLE

(75) Inventors: Robert Olsen, Medinah, IL (US); Scott George Thoennissen, Sandringham (AU)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/004,263

(22) Filed: Oct. 31, 2001

(65) Prior Publication Data

US 2003/0080004 A1 May 1, 2003

(51) Int. Cl.[7] ..... B65D 75/00
(52) U.S. Cl. ..... 206/150; 206/427; 206/459.5
(58) Field of Search ..... 206/150, 147, 206/151, 199, 232, 427, 459.5, 495.5, 161, 158, 170, 428, 145; 294/87.2, 87.28

(56) References Cited

U.S. PATENT DOCUMENTS

| | | | | |
|---|---|---|---|---|
| 4,093,295 A | | 6/1978 | Erickson | |
| 4,099,616 A | | 7/1978 | Klygis | |
| 4,300,681 A | | 11/1981 | Klygis et al. | |
| 4,509,639 A | | 4/1985 | Thompson | |
| 5,018,620 A | | 5/1991 | Marco et al. | |
| 5,024,014 A | | 6/1991 | Swierczek | |
| 5,072,829 A | * | 12/1991 | Marco et al. | 206/162 |
| 5,261,530 A | * | 11/1993 | Marco | 206/150 |
| 5,474,173 A | | 12/1995 | Hodapp | |
| 5,490,658 A | | 2/1996 | Coward et al. | |
| 5,542,634 A | | 8/1996 | Pomerantz | |
| 5,642,808 A | | 7/1997 | Marco et al. | |
| 5,653,334 A | | 8/1997 | Marco | |
| 5,755,474 A | | 5/1998 | Slomski | |
| 5,829,788 A | | 11/1998 | Jackson | |
| 5,868,659 A | | 2/1999 | Slomski | |
| 6,110,553 A | | 8/2000 | Grosskopf et al. | |
| 6,125,999 A | | 10/2000 | Slomski | |
| 6,129,959 A | | 10/2000 | Mercer et al. | |
| 6,148,994 A | | 11/2000 | Olsen | |
| 6,152,508 A | * | 11/2000 | Slomski | 294/87.2 |
| 6,170,652 B1 | | 1/2001 | Olsen | |
| 6,182,821 B1 | | 2/2001 | Olsen | |
| 6,230,880 B1 | * | 5/2001 | Marco et al. | 206/150 |
| 6,272,780 B1 | | 8/2001 | Satamian | |

FOREIGN PATENT DOCUMENTS

| | | |
|---|---|---|
| EP | 0 997 389 A1 | 5/2000 |
| EP | 1 004 518 A2 | 5/2000 |
| EP | 1 004 518 A3 | 10/2000 |

* cited by examiner

*Primary Examiner*—Jila M. Mohandesi
(74) *Attorney, Agent, or Firm*—Pauley Peterson & Erickson

(57) ABSTRACT

This invention relates to a package of a plurality of containers unitized with a flexible carrier. The carrier is constructed from a plastic planar sheet having a plurality of container receiving and a panel having an integral handle that extends from a longitudinal edge of the planar sheet.

10 Claims, 4 Drawing Sheets

LABEL PANEL CONTAINER CARRIER WITH INTEGRAL HANDLE

BACKGROUND OF THE INVENTION

1. Field of the Invention

This invention relates to a carrier for unitizing containers having a plurality of container receiving openings and an integral panel and handle.

2. Description of Prior Art

Conventional container carriers are often used to unitize a plurality of similarly sized containers, such as cans, bottles, jars and boxes and/or similar containers that require unitization. Plastic ring carriers and box carriers are two such conventional container carriers.

The plastic ring carrier produces a unitized package for containers using little material. However, when used alone has little or no advertising or promotional printing space. Conversely, the box carrier generally has a relatively large amount of area for promotional graphics. Disadvantageously, the box carrier requires a relatively large amount of material, permits bottles to fall out if it is not maintained in an upright position, and usually shrouds much of the actual containers. Therefore, there is a need for a package that incorporates the stability and economy of a ring carrier and the promotional area of a box carrier.

SUMMARY OF THE INVENTION

It is one object of this invention to provide a container carrier that provides a panel for merchandising information.

It is still another object of this invention to provide a container carrier which restricts lateral and vertical movement of the containers with respect to one another.

It is yet another object of this invention to provide a container carrier that incorporates the stability and economy of a ring carrier and the promotional area of a box carrier.

It is yet another object of this invention to provide a panel having an integral handle that is easily grasped and can support the weight of a package of containers.

A carrier according to this invention carries a plurality of containers such as bottles. The carrier comprises a planar, preferably plastic, sheet formed with a plurality of container receiving openings, preferably in a longitudinal row.

According to one preferred embodiment of this invention, the containers are positioned in each container receiving opening to form a package having a panel that is flat, tight and parallel with respect to the containers and prominent with respect to the package. Such a configuration of the panel results in a package of containers having a prominent display area or "billboard" for advertising, information, graphics and other marketing material. An integral handle is positioned within along a periphery of the panel to permit a purchaser to easily and comfortably grasp the package.

When the handle is grasped and lifted, the panel preferably inverts with respect to the package and the containers are then carried at an angle with respect to the horizontal. This results in a package that is comfortable to carry and a secure, unitized group of containers.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
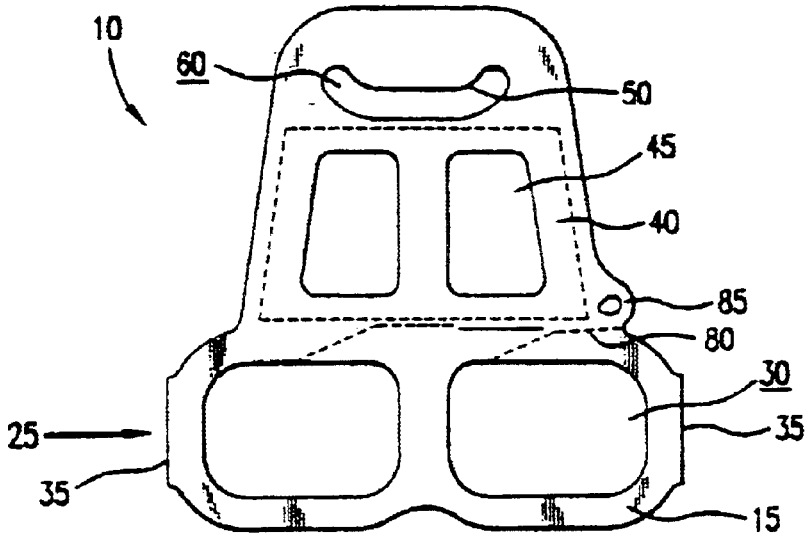
FIG. 1 is a top view of a carrier for holding two containers according to one preferred embodiment of this invention.
Figure 2:
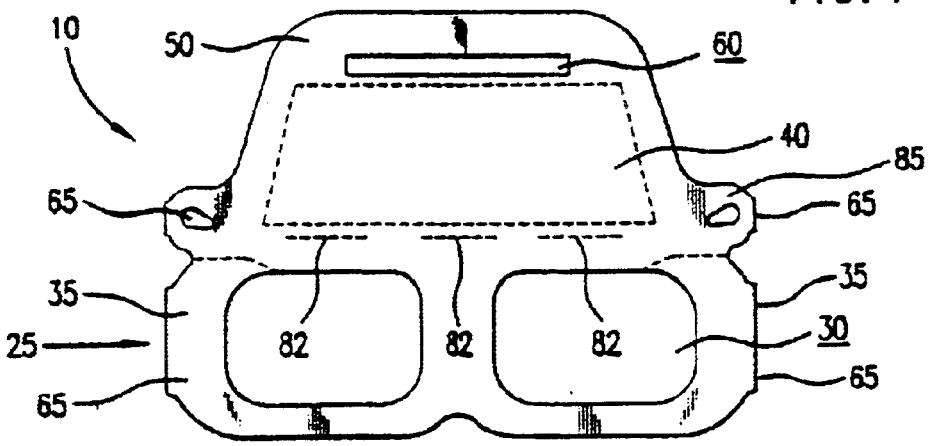
FIG. 2 is a top view of a carrier for holding two containers according to one preferred embodiment of this invention.
Figure 3:
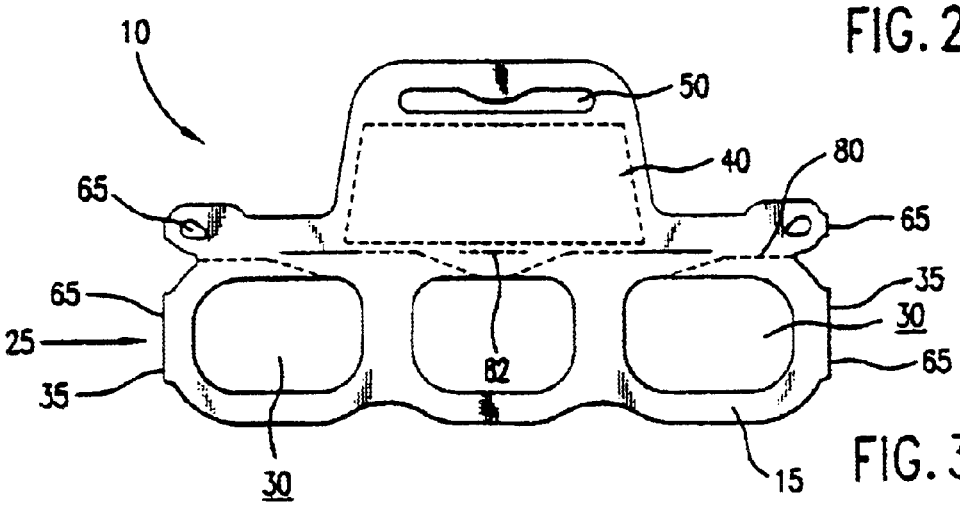
FIG. 3 is a top view of a carrier for holding three containers according to one preferred embodiment of this invention.
Figure 4:
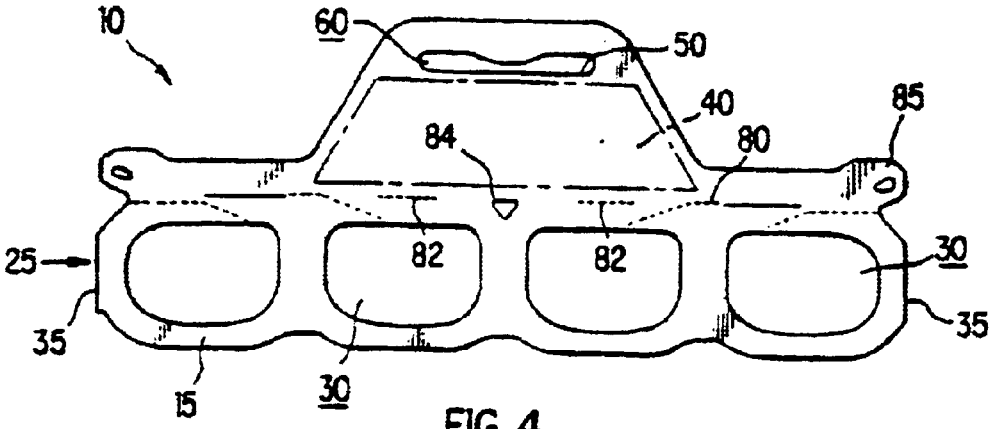
FIG. 4 is a top view of a carrier for holding four containers according to one preferred embodiment of this invention.
Figure 5:
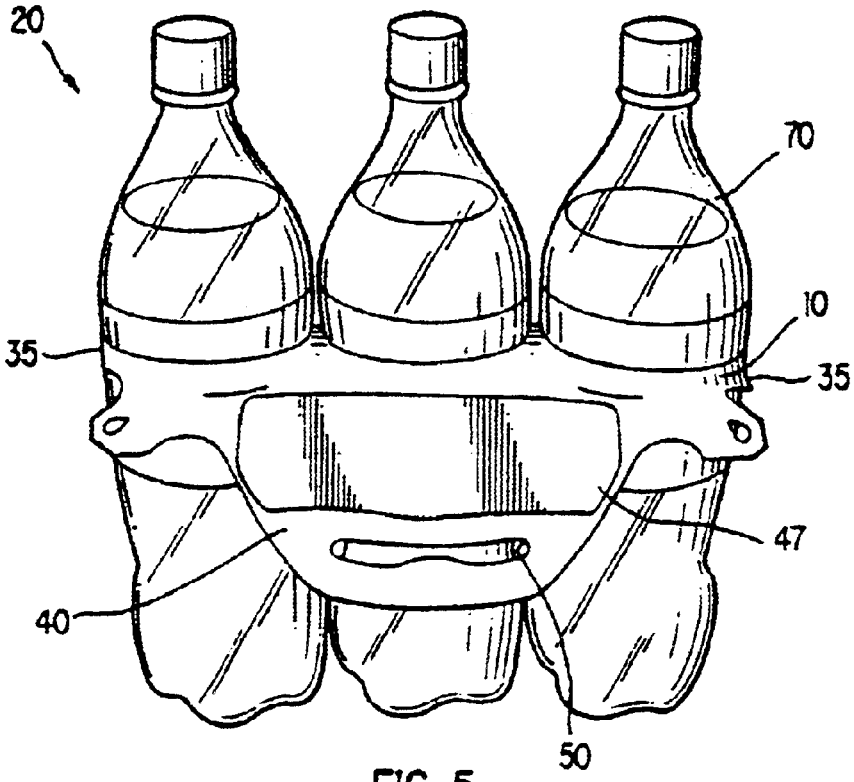
FIG. 5 is a front view of a package of three containers using a carrier according to one preferred embodiment of this invention.
Figure 6:
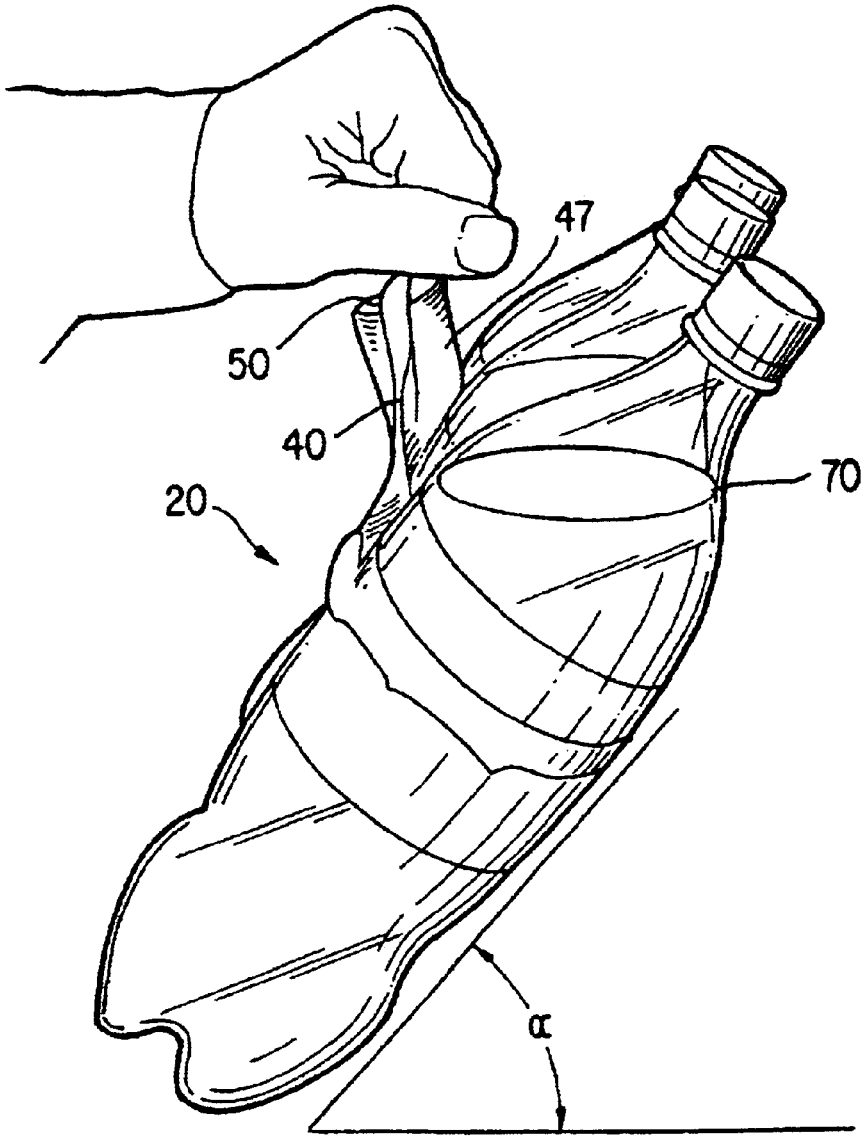
FIG. 6 is a side view of a package of three containers using a carrier according to one preferred embodiment of this invention.

FIGS. 1–8 show carrier 10 for carrying a plurality of containers 70. Containers 70, such as those shown in packages 20 in FIGS. 5–8, are preferably bottles. Although bottles are shown in FIGS. 5 and 6, cans or any other commonly unitized container 70 may be used with carrier 10 according to this invention. Containers 70 are preferably like-sized within a single carrier 10.

Carrier 10 unitizes a plurality of containers 70 to create package 20, such as package 20 shown in FIGS. 5–8. Carrier 10 comprises planar sheet 15 preferably constructed from a flexible, resilient material such as plastic, and in one embodiment, low density polyethylene. In one preferred embodiment of this invention, planar sheet 15 is made from low density polyethylene.

Planar sheet 15 of material is preferably cut, using means known to those skilled in the art, such as a stamping die, to form a plurality of container receiving openings 30 in planar sheet 15. Container receiving openings 30 are preferably formed in a generally rectangular shape having rounded corners. Planar sheet 15 may include other configurations of container receiving openings 30 depending on the size of package 20 desired. As shown in FIGS. 1–4, in alternate preferred embodiments of this invention, carrier 10 comprises sheet 15 having two, three and four container receiving openings 20.

Preferably, container receiving openings 30 are arranged in a longitudinal row 25. However, other arrangements of container receiving openings 30, including an array of longitudinal rows 25 and transverse ranks may be possible.

In addition to container receiving openings 30, panel 40 is additionally positioned on carrier 10 and preferably extends transversely from longitudinal row 25 of container receiving openings 30. Panel 40 is preferably as large or larger than a width of container receiving openings 30 and has an overall longitudinal panel length that approaches an overall length of longitudinal row 25. Panel 40 preferably accommodates, on one or both sides, UPC and proof of purchase labels, graphics, and promotional and/or other information related to contents and/or ingredients of containers 70 and/or package 20.

According to one alternative embodiment of this invention, panel 40 may extend from each side of carrier 10 resulting in two panels 40, each extending from opposite sides of longitudinal row 25. This configuration permits a panel 40 to face outward from a shelf regardless of how carrier 10 is placed on the shelf.

Panel 40 may be generally continuous and unbroken, without cutouts or apertures, throughout its defined area. Alternatively, and as shown in FIGS. 1–4, panel 40 may include one or more cutouts 45 for weight reduction and material savings. An adhesive label 47 may be applied to panel 40 to bring color, graphics and/or other information to panel 40.

As shown in FIGS. 1–4, panel 40 is preferably tapered along transverse panel edges 37. Panel preferably additionally extends in a transverse direction for a height less than a height of container 70.

Handle 50 is additionally positioned along an outer periphery, or on an outboard side of panel 40. Handle 50 may comprise an elongated aperture 60 positioned along the outer periphery of panel 40 or other configuration that provides an ample area for a purchaser to grab by inserting his hand through and still maintain the purpose and integrity of panel 40. As shown in the figures, handle 50 preferably extends for much of a width of panel 40 across the outer periphery of panel 40.

Carrier 10 is preferably manufactured so that a plurality of adjacent carriers 10 are punched and then wound onto a spool (not shown) having several thousand carriers 10, each carrier 10 attached to each adjacent carrier 10 at each edge 35. Before carriers 10 are later applied to containers 70 to form packages 20, carriers 10 are preferably unwound from spools and then separated from each other between adjacent edges 35. According to a preferred embodiment of this invention, carriers 10 include at least two attachment points 65 at each edge 35 for connection with corresponding attachment points 65 at each edge 35 of adjacent carriers 10 in a spool. According to one preferred embodiment of this invention, one attachment point 65 is at an edge of the longitudinal row 25 of container receiving openings 30 and one attachment point 65 is at a pull tab 85, discussed in more detail below.

FIGS. 5–8 show package 20 comprising carrier 10 unitizing a plurality of containers 70. Package 20 preferably includes two or more long, cylindrical bottles, such as bottles holding between 1 and 2 fluid liters. Such bottles are larger than most containers 70 that are generally unitized and thus may require a carrier 10 having particular enhancements not found on conventional carriers to facilitate ease of carrying.

Figure 7:
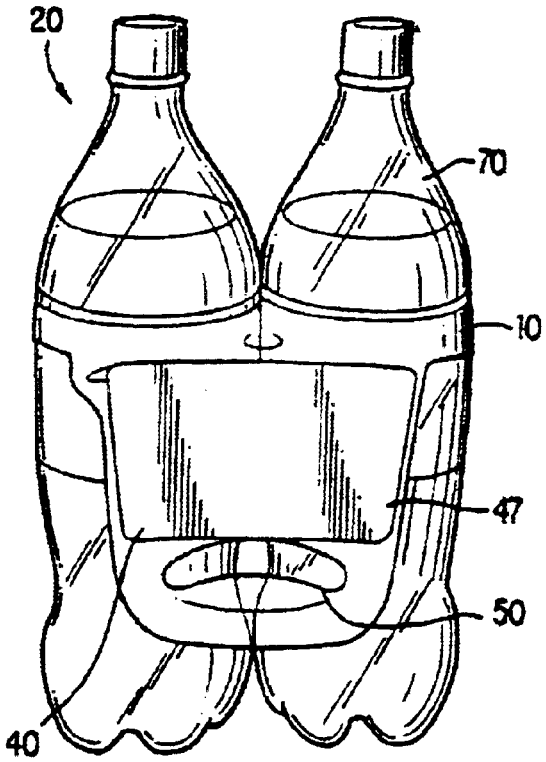
FIG. 7 is a front view of a package of two containers using a carrier according to one preferred embodiment of this invention.

FIGS. 5 and 7 show carrier 10 and package 20 wherein panel 40 is formed to align in a generally flat position relative to package 20. Such a panel configuration results in a large, visible and unobstructed billboard area on a side of package 20. Such a panel configuration results in a large billboard area on a side of package 20 that does not protrude from package 20 thus reducing the likelihood of snagging or interfering with adjacent packages.

As shown in FIGS. 5–8, container 70 is positioned in each container receiving opening 30 to form package 20. According to one preferred embodiment of this invention, when carrier 10 is installed on containers 70, panel 40 is preferably parallel with respect to containers 70 depending downwardly from longitudinal row of container receiving openings 30 and prominent with respect to package 20. If panel 40 is curled or folded in a perpendicular position with respect to package 20, then advertising or other material positioned on panel 40 will not be legible to a consumer. In addition, if panel 40 protrudes outwardly with respect to package 20, it will create difficulties in packaging, handling and stacking packages 20 because of interference between panels 40 of adjacent packages 20 and between panel 40 and packaging equipment. Panel 40 depends downwardly by proper sizing and location of panel 40 with respect to container receiving openings 30, as well as the line of weakness 80 and weakened area 82 and possibly a cutout 84 depending upon the size of carrier 10 and containers 70.

Figure 8:
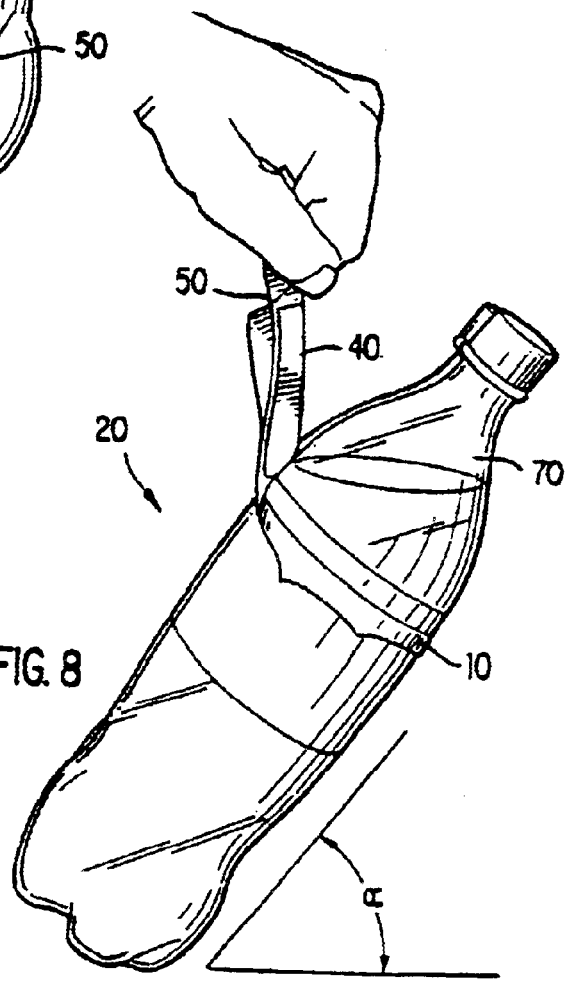
FIG. 8 is a side view of a package of two containers using a carrier according to one preferred embodiment of this invention.

As previously discussed, handle 50 is positioned along an outer periphery of panel 40 so that when package 20 is lifted by a purchaser, panel 40 inverts upwardly and at least partially against containers 70. Accordingly, and as best shown in FIGS. 6 and 8, handle 50 is preferably positioned in panel 40 so that when handle 50 is grasped and lifted, panel 40 is inverted. Weakened area 82 is preferably positioned between panel 40 and longitudinal row 25 of container receiving openings 30 to help panel 40 invert by folding along weakened area 82 to create a sharp crease rather than a gentle roll. The sharp crease preferably created around weakened area 82 also helps to retain containers 70 within container receiving openings 30 when handle 50 is grasped and lifted by a consumer.

As shown in FIGS. 5–8, containers 70 are preferably bottles and container receiving openings 30 are positioned on the bottles so that they are carried at an angle $\alpha$, preferably between approximately 30° and 75° with respect to horizontal, and more preferably between approximately 45° and 60° with respect to horizontal. This angle $\alpha$ at which containers 70 are carried results in a comfortable and ergonomic package 20 for the purchaser, particularly for larger containers 70 such as 2 liter bottles.

According to one preferred embodiment of this invention, carrier 10 further comprises line of weakness 80 positioned between panel 40 and longitudinal row 25 of container receiving openings 30. Line of weakness 80 may be serrations, slits or holes in carrier 10 and is preferably tearable to permit removable of each container 70 from within each respective container receiving opening 30. Pull tab 85 may be positioned to extend from line of weakness 80 thus facilitating removal of containers 70 from package 20.

While in the foregoing specification this invention has been described in relation to certain preferred embodiments thereof, and many details have been set forth for purpose of illustration, it will be apparent to those skilled in the art that carrier 10 is susceptible to additional embodiments and that certain of the details described herein can be varied considerably without departing from the basic principles of the invention.

We claim:

1. A package of a plurality of containers comprising:

a planar sheet of a flexible plastic material having a plurality of container receiving openings arranged in exactly one longitudinal row, each container receiving opening engaging a container;

a panel extending transversely and downwardly from the longitudinal row of container receiving openings;

a handle comprising an aperture positioned along an outer periphery of the panel so that when the package is lifted, the panel inverts upwardly and at least partially against the containers so that the containers are carried at an angle between approximately 30° and 75° with respect to horizontal; and a weakened area positioned between the panel and the longitudinal row of container receiving openings, the weakened area for generating a sharp crease when the panel is inverted.

2. The package of claim 1 wherein the handle comprises an elongated aperture positioned along the outer periphery of the panel.

3. The package of claim 1 wherein the plurality of containers are bottles and the container receiving openings are positioned on the bottles so that the bottles are carried at an angle between approximately 45° and 60° with respect to horizontal.

4. The package of claim 1 further comprising a line of weakness positioned between the panel and the containers.

5. The package of claim 4 further comprising a pull tab extending from the line of weakness.

6. The package of claim 4 wherein the panel is flush and flat with respect to the containers to display product information when the package is in a static condition and the panel is inverted with respect to the containers when the package is carried.

7. A package of a plurality of bottles comprising:

a planar sheet of a flexible plastic material having a plurality of container receiving openings arranged in only one longitudinal row, each container receiving opening engaging a bottle along a sidewall between a cap of the bottle and an approximate midpoint of the sidewall;

a panel extending transversely and downwardly from the longitudinal row of container receiving openings;

a handle formed of an elongated aperture positioned along an outer periphery of the panel so that when the package is lifted, the panel inverts upwardly so that the bottles are carried at an angle between approximately 30° and 75° with respect to horizontal; and a weakened area positioned between the panel and the longitudinal row of container receiving openings, the weakened area for generating a sharp crease when the panel is inverted.

8. The package of claim 7 further comprising an adhesive label applied to the panel.

9. The package of claim 7 further comprising a line of weakness extending between the panel and the bottles, the line of weakness tearable to permit removable of each bottle from within the respective container receiving openings.

10. The package of claim 7 comprising two or more bottles, each between 1 and 2 liters.

* * * * *